US010578996B2

(12) United States Patent
Morita

(10) Patent No.: US 10,578,996 B2
(45) Date of Patent: Mar. 3, 2020

(54) INTERMEDIATE TRANSFER UNIT AND IMAGE FORMING APPARATUS THAT COLLECT SCATTERED TONER

(71) Applicant: KYOCERA Document Solutions Inc., Osaka (JP)

(72) Inventor: Takashi Morita, Osaka (JP)

(73) Assignee: KYOCERA Document Solutions, Inc., Tamatsukuri, Chuo-ku, Osaka (JP)

( * ) Notice: Subject to any disclaimer, the term of this patent is extended or adjusted under 35 U.S.C. 154(b) by 0 days.

(21) Appl. No.: 16/150,811

(22) Filed: Oct. 3, 2018

(65) Prior Publication Data

US 2019/0107796 A1 Apr. 11, 2019

(30) Foreign Application Priority Data

Oct. 5, 2017 (JP) ..... 2017-195404

(51) Int. Cl.
*G03G 15/16* (2006.01)
*G03G 15/00* (2006.01)
(Continued)

(52) U.S. Cl.
CPC ..... *G03G 15/161* (2013.01); *G03G 15/0189* (2013.01); *G03G 15/0898* (2013.01);
(Continued)

(58) Field of Classification Search
CPC ..... G03G 15/161; G03G 15/0189; G03G 15/752; G03G 15/0898; G03G 15/0942;
(Continued)

(56) References Cited

U.S. PATENT DOCUMENTS 4,093,368 A * 6/1978 Nishikawa ..... G03G 15/052 399/135
5,179,412 A * 1/1993 Yamada ..... G03G 15/1635 399/168
(Continued)

FOREIGN PATENT DOCUMENTS

JP 56162774 A * 12/1981 ..... G03G 15/107
JP 57158853 A * 9/1982 ..... G03G 21/206
(Continued)

*Primary Examiner* — David M. Gray
*Assistant Examiner* — Laura Roth
(74) *Attorney, Agent, or Firm* — IP Business Solutions, LLC

(57) ABSTRACT

An intermediate transfer unit includes an intermediate transfer belt, a plurality of transfer rollers, a housing, and a filter unit. The intermediate transfer belt is mounted around a drive roller and a driven roller and capable of traveling in an endless path around the rollers. The housing holds the intermediate transfer belt and the transfer rollers. The filter unit includes: a suction portion; an exhaust portion; and a rectangular chassis provided internally with an upstream filter and a downstream filter both capable of collecting powder particles. The filter unit is disposed inside of the intermediate transfer belt so that a direction of length of the chassis is oriented parallel to a direction of width of the intermediate transfer belt perpendicular to a direction of travel of the intermediate transfer belt, and the filter unit is fixed to the housing.

9 Claims, 12 Drawing Sheets

(51) Int. Cl.
*G03G 15/08* (2006.01)
*G03G 15/01* (2006.01)
*G03G 21/20* (2006.01)

(52) U.S. Cl.
CPC ..... *G03G 15/752* (2013.01); *G03G 21/20* (2013.01); *G03G 21/206* (2013.01); *G03G 2221/1645* (2013.01)

(58) Field of Classification Search
CPC ..... G03G 21/1832; G03G 2221/1648; G03G 21/206; G03G 2221/1645
See application file for complete search history.

(56) References Cited

U.S. PATENT DOCUMENTS 7,937,014 B2 * 5/2011 Kawamata ..... G03G 21/206 399/110
2004/0101328 A1 * 5/2004 Kimura ..... G03G 15/751 399/111
2006/0120748 A1 * 6/2006 Takehara ..... G03G 21/206 399/92
2010/0098452 A1 * 4/2010 Inaba ..... G03G 21/1853 399/92
2011/0008067 A1 * 1/2011 Okada ..... G03G 21/10 399/92
2011/0280609 A1 * 11/2011 Nakazawa ..... G03G 21/206 399/92
2012/0328344 A1 * 12/2012 Kunii ..... G03G 15/2021 399/341
2012/0328346 A1 * 12/2012 Amita ..... G03G 15/0189 399/341
2013/0016992 A1 * 1/2013 Watanabe ..... G03G 15/04036 399/92
2014/0140719 A1 * 5/2014 Suzuki ..... G03G 15/0189 399/92
2016/0124384 A1 5/2016 Mizutani
2017/0283198 A1 * 10/2017 Yoshida ..... B65H 5/062

FOREIGN PATENT DOCUMENTS

JP 2009276478 A * 11/2009 ..... G03G 15/167
JP 2016-090671 A 5/2016

* cited by examiner

INTERMEDIATE TRANSFER UNIT AND IMAGE FORMING APPARATUS THAT COLLECT SCATTERED TONER

INCORPORATION BY REFERENCE

This application claims priority to Japanese Patent Application No. 2017-195404 filed on Oct. 5, 2017, the entire contents of which are incorporated by reference herein.

BACKGROUND

The present disclosure relates to intermediate transfer units and image forming apparatuses and particularly relates to a technique for collecting scattered toner.

A general image forming apparatus includes a photosensitive drum as an image carrier, a charging device, an exposure device, a developing device, and a transfer device, wherein an image formation process (charging, exposure, development, and transfer) is performed on the photosensitive drum to form a toner image on a recording medium.

If the toner flowability or the amount of charge on toner particles decreases, the toner becomes less likely to adhere to the photosensitive drum, so that toner scattering may occur to contaminate the interior and exterior of the image forming apparatus or the toner may fall onto an image to cause an image defect.

SUMMARY

A technique improved over the above technique is proposed as one aspect of the present disclosure.

An intermediate transfer unit according to an aspect of the present disclosure includes an intermediate transfer belt, a plurality of transfer rollers, a housing, and a filter unit. The intermediate transfer belt is mounted around two belt rollers to travel in an endless path around the belt rollers. The plurality of transfer rollers are disposed opposite to a plurality of image carriers with the intermediate transfer belt in between, the plurality of image carriers being aligned along an outer periphery of the intermediate transfer belt and allowing respective toner images to be formed thereon, and transfers the toner images from the image carriers to the outer periphery of the intermediate transfer belt. The housing journals the intermediate transfer belt and the transfer rollers. The filter unit includes: a suction portion provided at a front end thereof to suck air therethrough; an exhaust portion provided at a rear end thereof to exhaust the air therethrough; and a rectangular chassis provided internally with a filter capable of collecting powder particles. The filter unit is disposed inside of the intermediate transfer belt mounted around the two belt rollers so that a direction of length of the chassis equal to a direction of the air flowing through an interior of the chassis is oriented parallel to a direction of width of the intermediate transfer belt perpendicular to a direction of travel of the intermediate transfer belt, and the filter unit is fixed to the housing.

An image forming apparatus according to another aspect of the present disclosure includes the above intermediate transfer unit and transfers a toner image formed by the intermediate transfer unit to a recording medium to form an image.

DETAILED DESCRIPTION

Figure 1A:
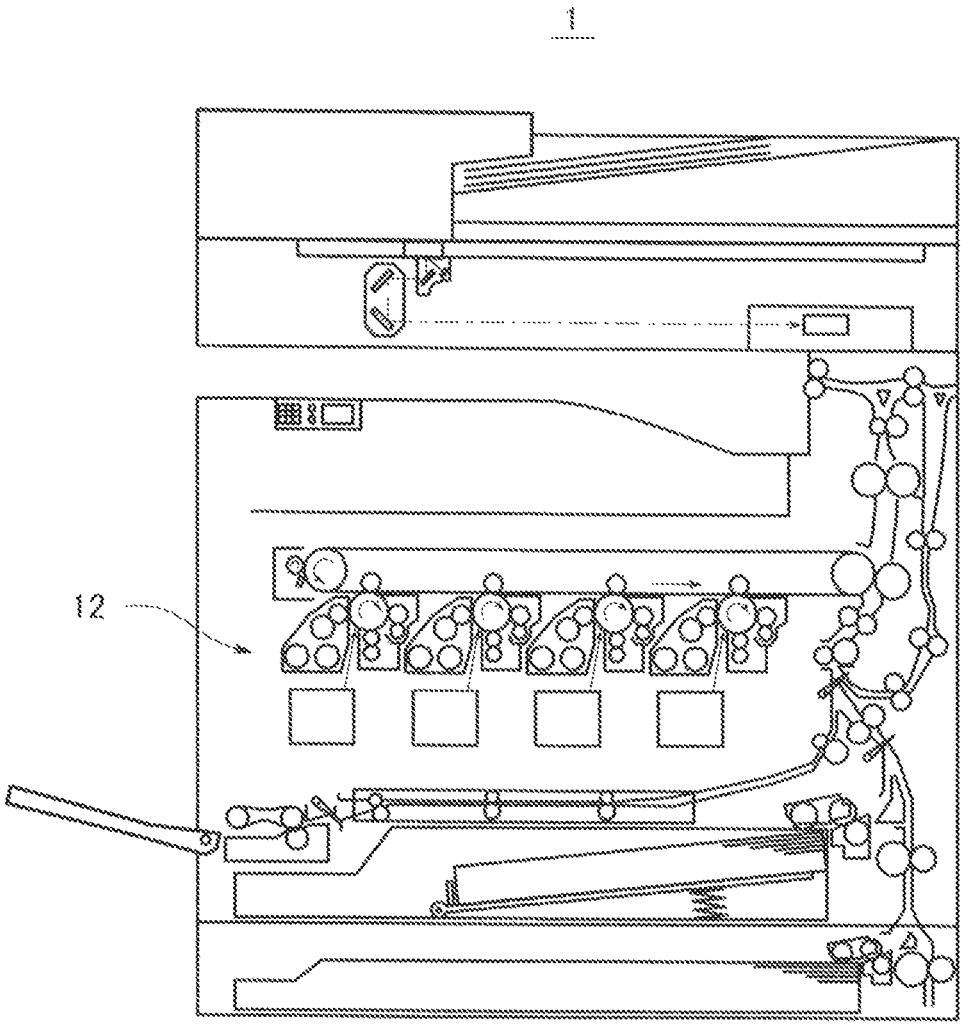
FIG. 1A is a side view showing an internal structure of one embodiment of an image forming apparatus according to the present disclosure.
Figure 1B:
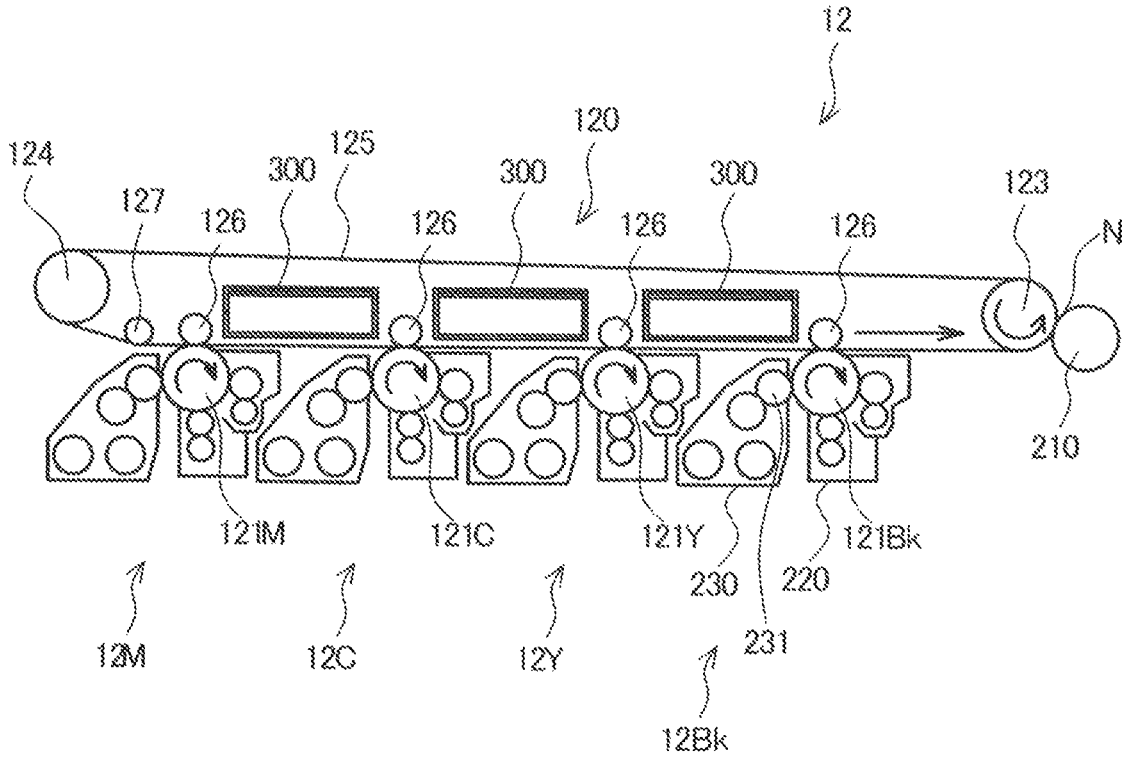
FIG. 1B is a front view schematically showing an image forming section constituting part of an image forming apparatus according to a first embodiment of the present disclosure and its surrounding portions.

Hereinafter, a description will be given of a filter unit and an image forming apparatus including the filter unit, both according to an embodiment of the present disclosure, with reference to the drawings. FIG. 1A is a side view showing an internal structure of one embodiment of an image forming apparatus according to the present disclosure. FIG. 1B is a front view schematically showing an image forming section constituting part of an image forming apparatus according to a first embodiment of the present disclosure and its surrounding portions. The image forming apparatus 1 is a multifunction peripheral having multiple functions including, for example, a copy function, a print function, a scan function, and a facsimile function.

A description will be given below of the case where an image forming operation is performed on the image forming apparatus 1. An image forming section 12 forms a toner image on a recording paper sheet (recording medium) fed from a sheet feed section (now shown), based on image data generated by a document reading operation, image data stored on an internal HDD (hard disk drive), image data received from a network-connected computer or other images.

The image forming section 12 is made up by including an image forming unit 12Bk for black (Bk), an image forming unit 12Y for yellow (Y), an image forming unit 12C for cyan (C), and an image forming unit 12M for magenta (M). The image forming units 12Bk, 12Y, 12C, and 12M include their respective photosensitive drums 121Bk, 121Y, 121C, and 121M serving as image carriers, their respective charging devices 220 capable of charging the surfaces of the photosensitive drums 121Bk, 121Y, 121C, and 121M, and their respective developing devices 230 capable of forming respective toner images on the photosensitive drums 121Bk, 121Y, 121C, and 121M. The photosensitive drums 121Bk, 121Y, 121C, and 121M are driven into rotation clockwise in the figure.

An intermediate transfer unit 120 is made up by including: an intermediate transfer belt 125 having an outer peripheral surface to which toner images are to be transferred; a drive roller 123; a driven roller 124; a plurality of primary transfer rollers 126; and a tension roller 127.

The primary transfer rollers 126 are disposed opposite to the respective associated photosensitive drums 121Bk, 121Y, 121C, and 121M aligned along the outer periphery of the intermediate transfer belt 125, with the intermediate transfer belt 125 in between. The primary transfer roller 126 is an example of the transfer roller defined in What is claimed is.

The intermediate transfer belt 125 is mounted between the drive roller 123 and the driven roller 124, driven in engagement against the peripheral surfaces of the photosensitive drums 121Bk, 121Y, 121C, and 121M by the drive roller 123, and travels in an endless path around the rollers 123, 124 while synchronizing with each photosensitive drum 121Bk, 121Y, 121C, 121M. The drive roller 123 drives the intermediate transfer belt 125 while rotating counterclockwise in the figure. The intermediate transfer belt 125 is supported from inside by the tension roller 127 disposed in the vicinity of the driven roller 124. The drive roller 123 and the driven roller 124 are examples of the belt rollers defined in What is claimed is.

The peripheral surfaces of the photosensitive drums 121Bk, 121Y, 121C, and 121M are uniformly electrically changed (charging process) and the charged surfaces of the photosensitive drums 121Bk, 121Y, 121C, and 121M are irradiated with laser light based on image data to form respective latent images thereon (exposure process). The latent images formed on the surfaces of the photosensitive drums 121Bk, 121Y, 121C, and 121M are made visible with toner fed from the developing rollers 231 each constituting part of the associated developing device 230 (development process), and the toner images formed by making the visible images are transferred onto the intermediate transfer belt 125 by the primary transfer rollers 126.

The toner images of different colors (black, yellow, cyan, and magenta) transferred to the intermediate transfer belt 125 are superimposed each other on the intermediate transfer belt 125 by adjusting their transfer timings, resulting in a multicolor toner image.

A secondary transfer roller 210 transfers the multicolor toner image formed on the surface of the intermediate transfer belt 125, at a nip N between the secondary transfer roller 210 and the drive roller 123 with the intermediate transfer belt 125 in between, to a recording paper sheet conveyed from the sheet feed section.

Filter units 300 collect powder particles, such as toner, scattered without adhering to the photosensitive drums 121Bk, 121Y, 121C, and 121M and they are disposed inside of the intermediate transfer belt 125 mounted around the drive roller 123 and the driven roller 124. Each filter unit 300 is disposed between adjacent two of the primary transfer rollers 126. Each filter unit 300 is disposed so that the direction of extension of its upstream first ribs 323, its downstream first ribs 324, its upstream second ribs 313, and its downstream second ribs 314 is parallel to the direction of width of the intermediate transfer belt 125 perpendicular to the direction of travel of the intermediate transfer belt 125. The upstream first rib 323 and the downstream first rib 324 are examples of the first rib defined in What is claimed is. The upstream second rib 313 and the downstream second rib 314 are examples of the second rib defined in What is claimed is.

Figure 2:
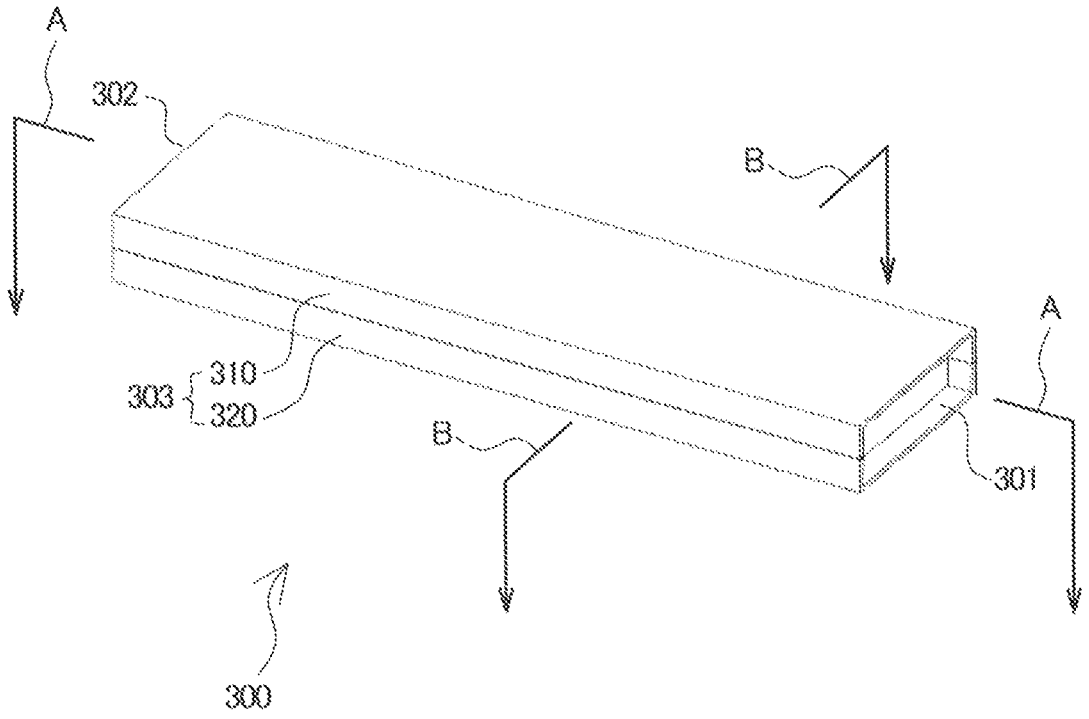
FIG. 2 is a perspective view showing a filter unit.

FIG. 2 is a perspective view showing the filter unit 300. The filter unit 300 includes a chassis 303 having, for example, a rectangular shape, provided at its front end with a suction portion 301, provided at its rear end with an exhaust portion 302, and provided internally with a filter (not shown in FIG. 2) capable of collecting powder particles, such as toner. The chassis 303 is made up by connecting an upper cover 310 and a lower cover 320.

Figure 3A:
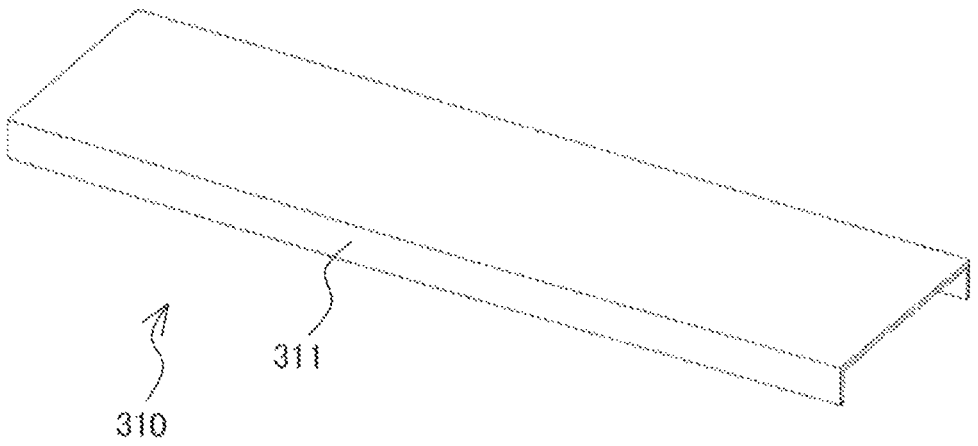
FIG. 3A is a perspective view of an upper cover of the filter unit when viewed from above.
Figure 3B:
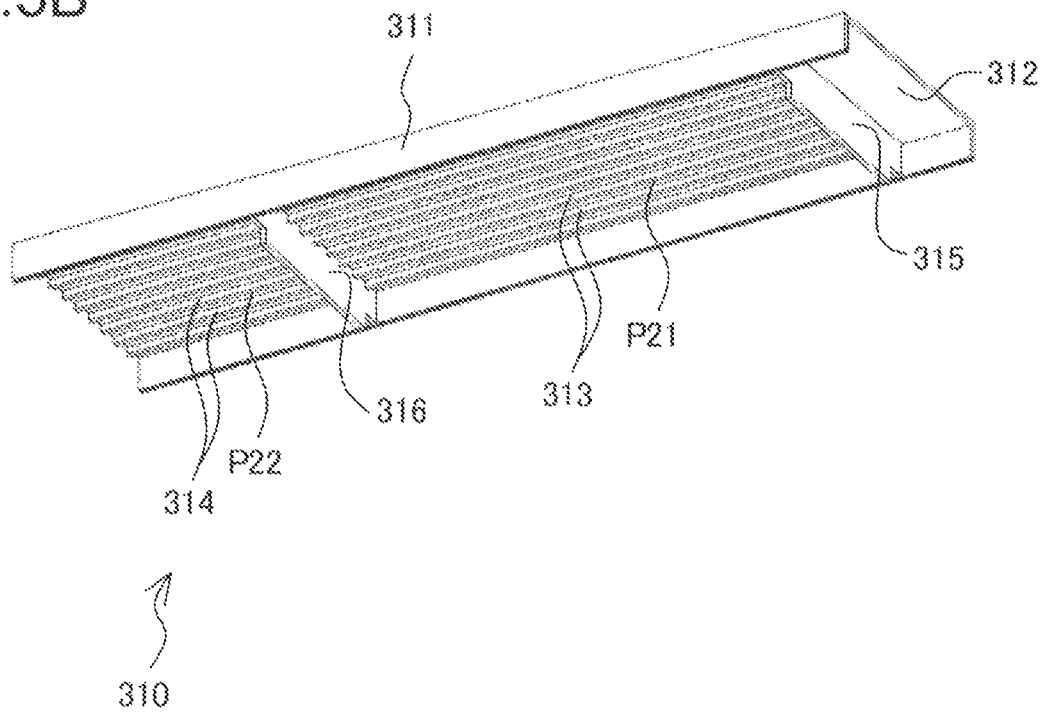
FIG. 3B is a perspective view of the upper cover of the filter unit when viewed from below.
Figure 4A:
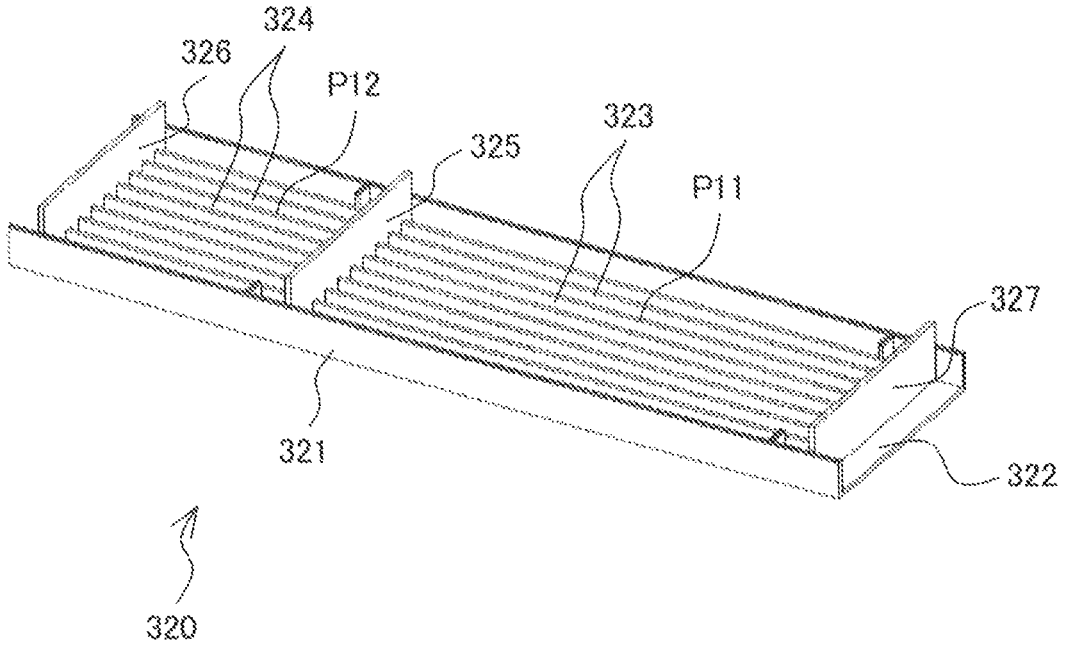
FIG. 4A is a perspective view of a lower cover of the filter unit when viewed from above.
Figure 4B:
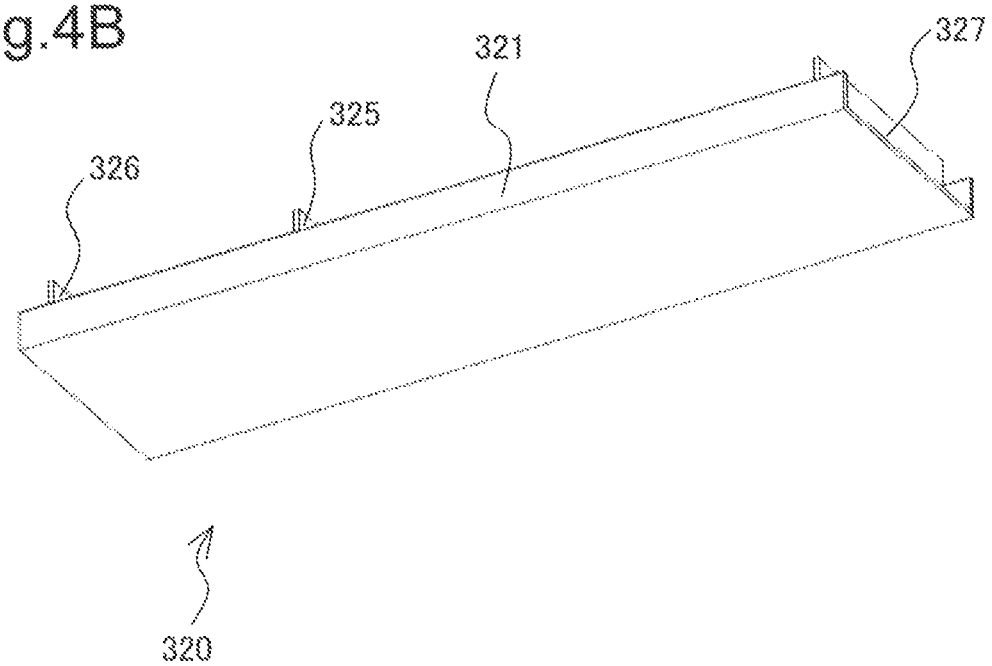
FIG. 4B is a perspective view of the lower cover of the filter unit when viewed from below.

FIG. 3A is a perspective view of the upper cover 310 of the filter unit 300 when viewed from above. FIG. 3B is a perspective view of the upper cover 310 of the filter unit 300 when viewed from below. FIG. 4A is a perspective view of the lower cover 320 of the filter unit 300 when viewed from above. FIG. 4B is a perspective view of the lower cover 320 of the filter unit 300 when viewed from below.

Figure 5A:
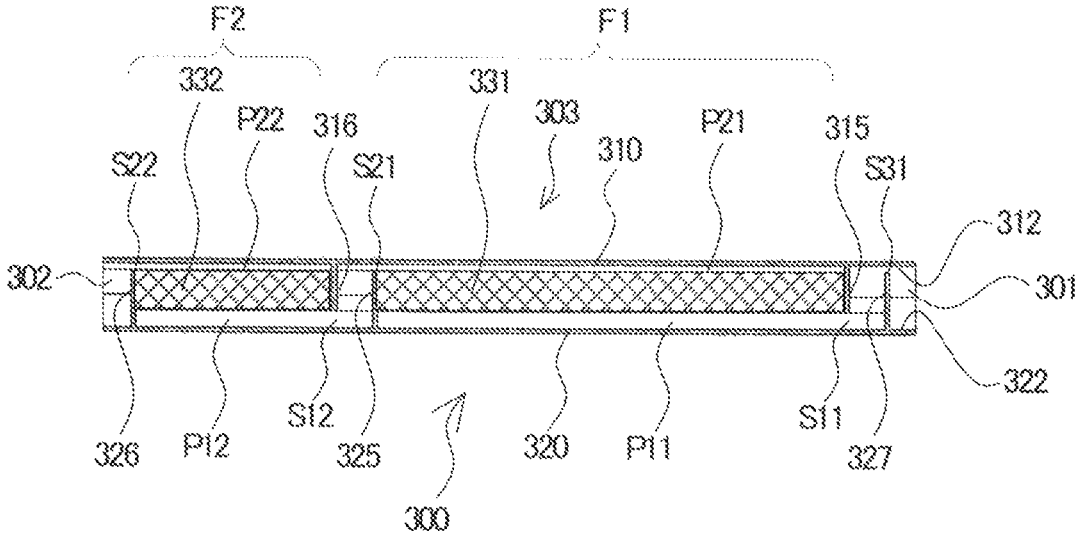
FIG. 5A is a cross-sectional view of the filter unit taken along the line A-A in FIG. 2.
Figure 5B:
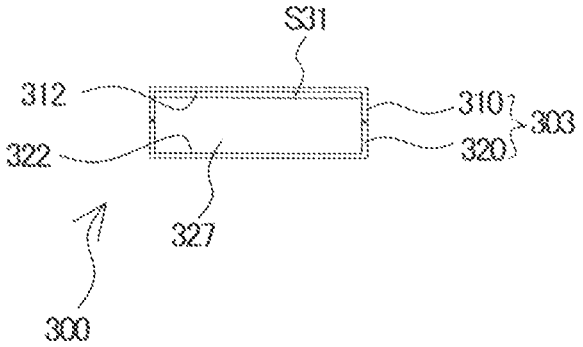
FIG. 5B is a front view of the filter unit.
Figure 5C:
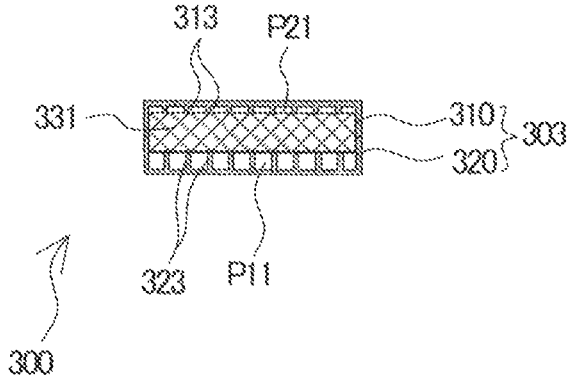
FIG. 5C is a cross-sectional view of the filter unit taken along the line B-B in FIG. 2.

FIG. 5A is a cross-sectional view of the filter unit 300 taken along the line A-A in FIG. 2. FIG. 5B is a front view of the filter unit 300. FIG. 5C is a cross-sectional view of the filter unit 300 taken along the line B-B in FIG. 2.

The lower cover 320 includes a plurality of upstream first ribs 323 and a plurality of downstream first ribs 324, each disposed parallel to sidewalls 321 of the lower cover 320 to rise from a bottom surface 322 thereof toward the inside of the chassis 303. The plurality of upstream first ribs 323 form an upstream first airflow path P11 between the upstream filter 331 and the bottom surface 322, while the plurality of downstream first ribs 324 form a downstream first airflow path P12 between the downstream filter 332 and the bottom surface 322. The upstream first airflow path P11 and the downstream first airflow path P12 are examples of the first airflow path defined in What is claimed is.

The upper cover 310 includes a plurality of upstream second ribs 313 and a plurality of downstream second ribs 314, each disposed parallel to sidewalls 311 of the upper cover 310 to rise from a ceiling surface 312 thereof. The plurality of upstream second ribs 313 form an upstream second airflow path P21 between the upstream filter 331 and the ceiling surface 312, while the plurality of downstream second ribs 314 form a downstream second airflow path P22 between the downstream filter 332 and the ceiling surface 312. The upstream first ribs 323, downstream first ribs 324, upstream second ribs 313, and downstream second ribs 314 are each formed to have an inter-rib pitch of, for example, 20 mm or less. The upstream second airflow path P21 and the downstream second airflow path P22 are examples of the second airflow path defined in What is claimed is.

The plurality of upstream first ribs 323 are arranged side by side in a direction perpendicular to the direction of extension of the upstream first rib 323 and downstream first rib 324 (i.e., the direction of air flow in the chassis 303) and the plurality of upstream second ribs 313 are arranged side by side in the direction perpendicular to the direction of extension of the upstream second rib 313 and downstream second rib 314 (i.e., the direction of air flow in the chassis 303). If the inter-rib pitch is narrowed, the air flow becomes faster and the atmospheric pressure decreases, so that the outside air becomes likely to be sucked in. Therefore, the upstream first ribs 323 and upstream second ribs 313 formed in the upstream side of the air flow (hereinafter referred to simply as the upstream side) where air needs to be taken in preferably have a narrower inter-rib pitch than the downstream first ribs 324 and downstream second ribs 314 formed in the downstream side of the air flow (hereinafter referred to simply as the downstream side).

The upstream filter 331 disposed in the interior of the chassis 303 constituted by the upper cover 310 and the lower cover 320 and located in a front stage (the upstream side) of the chassis 303 is held sandwiched between the plurality of upstream first ribs 323 and the plurality of upstream second ribs 313 from above and below, while the downstream filter 332 disposed in the interior of the chassis 303 and located in a rear stage (the downstream side) of the chassis 303 is held sandwiched between the plurality of downstream first ribs 324 and the plurality of downstream second ribs 314 from above and below. In addition, the upstream filter 331 and the downstream filter 332 are also held sandwiched between the sidewalls 311 and 321 of the chassis 303 (the upper cover 310 and the lower cover 320) from the right and left sides. Specifically, the upstream filter 331 and the downstream filter 332 are disposed in the interior of the chassis 303 so as to be sandwiched by the plurality of upstream first ribs 323, the plurality of downstream first ribs 324, the plurality of upstream second ribs 313, and the plurality of downstream second ribs 314 with respective spaces left from the ceiling surface 312 and the bottom surface 322.

The upstream filter 331 disposed in the upstream side preferably has a lower collection efficiency than the downstream filter 332 disposed in the downstream side. For example, the downstream filter 332 is finer than the upstream filter 331. Thus, powder particles can be collected dispersedly throughout the filter unit 300.

Furthermore, the inside of each filter may be configured so that its upstream side has a lower collection efficiency than its downstream side. For example, in the upstream filter 331, the coarseness may gradually decrease from the front end to the rear end (from the upstream end to the downstream end).

Moreover, the upstream filter 331 disposed in the upstream side is preferably larger than the downstream filter 332 disposed in the downstream side (for example, in terms of volume, projected area, and length in the direction of extension of the upstream first ribs 323, the downstream first ribs 324, the upstream second ribs 313, and the downstream second ribs 314). This embodiment employs a structure in which the upstream filter 331 is longer than the downstream filter 332 in the direction of extension of the upstream first ribs 323, the downstream first ribs 324, the upstream second ribs 313, and the downstream second ribs 314. The reason for this is that since the upstream filter 331 disposed in the upstream side is coarser and therefore has a lower collection efficiency, the collection performance is increased by increasing the volume.

The upper cover 310 includes an upstream first shield plate 315 raised from the ceiling surface 312 of the upper cover 310 to cover up the front end of the upstream filter 331 while forming an upstream first gap S11 with the bottom surface 322 of the lower cover 320. The reason for this is that air having entered the chassis 303 through the suction portion 301 from the outside, having passed through a third gap S31 to be described hereinafter, and then having passed through the upstream first gap S11 is directed to the upstream first airflow path P11. The upstream first shield plate 315 is provided so that the upstream first gap S11 has a vertical dimension equal to or smaller than that of the upstream first airflow path P11 (or the upstream first ribs 323).

The upper cover 310 further includes a downstream first shield plate 316 raised from the ceiling surface 312 of the upper cover 310 to cover up the front end of the downstream filter 332 while forming a downstream first gap S12 with the bottom surface 322 of the lower cover 320. The reason for this is that air having passed through an upstream second gap S21 and then having passed through the downstream first gap S12 is directed to the downstream first airflow path P12. The downstream first shield plate 316 is provided so that the downstream first gap S12 has a vertical dimension equal to or smaller than that of the downstream first airflow path P12 (or the downstream first ribs 324).

If the upstream first gap S11 and the downstream first gap S12 have a larger vertical dimension than the upstream first airflow path P11 and the downstream first airflow path P12, respectively, the air may not be directed to the upstream first airflow path P11 and the downstream first airflow path P12, respectively, but may directly enter the upstream filter 331 and the downstream filter 332 through their front surfaces, respectively. The upstream first gap S11 and the downstream first gap S12 are examples of the first gap defined in What is claimed is.

The upstream first shield plate 315 and the downstream first shield plate 316 are provided to extend in the direction perpendicular to the direction of extension of the upstream first ribs 323, the downstream first ribs 324, the upstream second ribs 313, and the downstream second ribs 314. The upstream first shield plate 315 and the downstream first shield plate 316 are examples of the first shield plate defined in What is claimed is.

On the other hand, the lower cover 320 includes an upstream second shield plate 325 raised from the bottom surface 322 of the lower cover 320 to cover up the rear surface of the upstream filter 331 while forming an upstream second gap S21 with the ceiling surface 312 of the upper cover 310. The upstream second shield plate 325 is provided so that the upstream second gap S21 has a vertical dimension equal to or smaller than that of the upstream second airflow path P21 (or the upstream second ribs 313).

The lower cover 320 further includes a downstream second shield plate 326 raised from the bottom surface 322 of the lower cover 320 to cover up the rear surface of the downstream filter 332 while forming a downstream second gap S22 with the ceiling surface 312 of the upper cover 310. The downstream second shield plate 326 is provided so that the downstream second gap S22 has a vertical dimension equal to or smaller than that of the downstream second airflow path P22 (or the downstream second ribs 314).

The upstream second shield plate 325 and the downstream second shield plate 326 are provided for the purpose of directing the air passing through the upstream filter 331 toward the upstream second airflow path P21 and for the purpose of directing the air passing through the downstream filter 332 toward the downstream second airflow path P22, respectively. If the upstream second gap S21 and the downstream second gap S22 have a larger vertical dimension than the upstream second airflow path P21 and the downstream second airflow path P22, respectively, the air may not be directed to the upstream second airflow path P21 and the downstream second airflow path P22, respectively, but may exit through the rear surfaces of the upstream filter 331 and the downstream filter 332, respectively. The upstream second gap S21 and the downstream second gap S22 are examples of the second gap defined in What is claimed is. The upstream second shield plate 325 and the downstream second shield plate 326 are examples of the second shield plate defined in What is claimed is.

The upstream filter 331 is held sandwiched between the upstream first shield plate 315 and the upstream second shield plate 325 from the front and rear sides, while the downstream filter 332 is held sandwiched between the downstream first shield plate 316 and the downstream second shield plate 326 from the front and rear sides.

The upstream filter 331 is held sandwiched between the upstream first shield plate 315 and the upstream second shield plate 325 in the direction of extension of the upstream first ribs 323, the downstream first ribs 324, the upstream second ribs 313, and the downstream second ribs 314 and held sandwiched between the sidewalls 311 and 321 in the direction perpendicular to the direction of extension of the upstream first ribs 323, the downstream first ribs 324, the upstream second ribs 313, and the downstream second ribs 314.

On the other hand, the downstream filter 332 is held sandwiched between the downstream first shield plate 316 and the downstream second shield plate 326 in the direction of extension of the upstream first ribs 323, the downstream first ribs 324, the upstream second ribs 313, and the downstream second ribs 314 and held sandwiched between the sidewalls 311 and 321 in the direction perpendicular to the direction of extension of the upstream first ribs 323, the downstream first ribs 324, the upstream second ribs 313, and the downstream second ribs 314.

The lower cover 320 further includes a third shield plate 327 in the vicinity of the suction portion 301 through which air is sucked from the outside into the chassis 303. The third shield plate 327 is provided to extend and rise from the bottom surface 322 of the lower cover 320 while forming a third gap S31 with the ceiling surface 312 of the upper cover 310. The third shield plate 327 has, for example, the effect of preventing powder particles accumulated in the upstream first airflow path P11 from leaking to the outside. The third shield plate 327 extends in the direction perpendicular to the direction of extension of the upstream first ribs 323, the downstream first ribs 324, the upstream second ribs 313, and the downstream second ribs 314 and is disposed somewhere between the suction portion 301 and the upstream first shield plate 315 in the direction of extension of the upstream first ribs 323, the downstream first ribs 324, the upstream second ribs 313, and the downstream second ribs 314.

Figure 6:
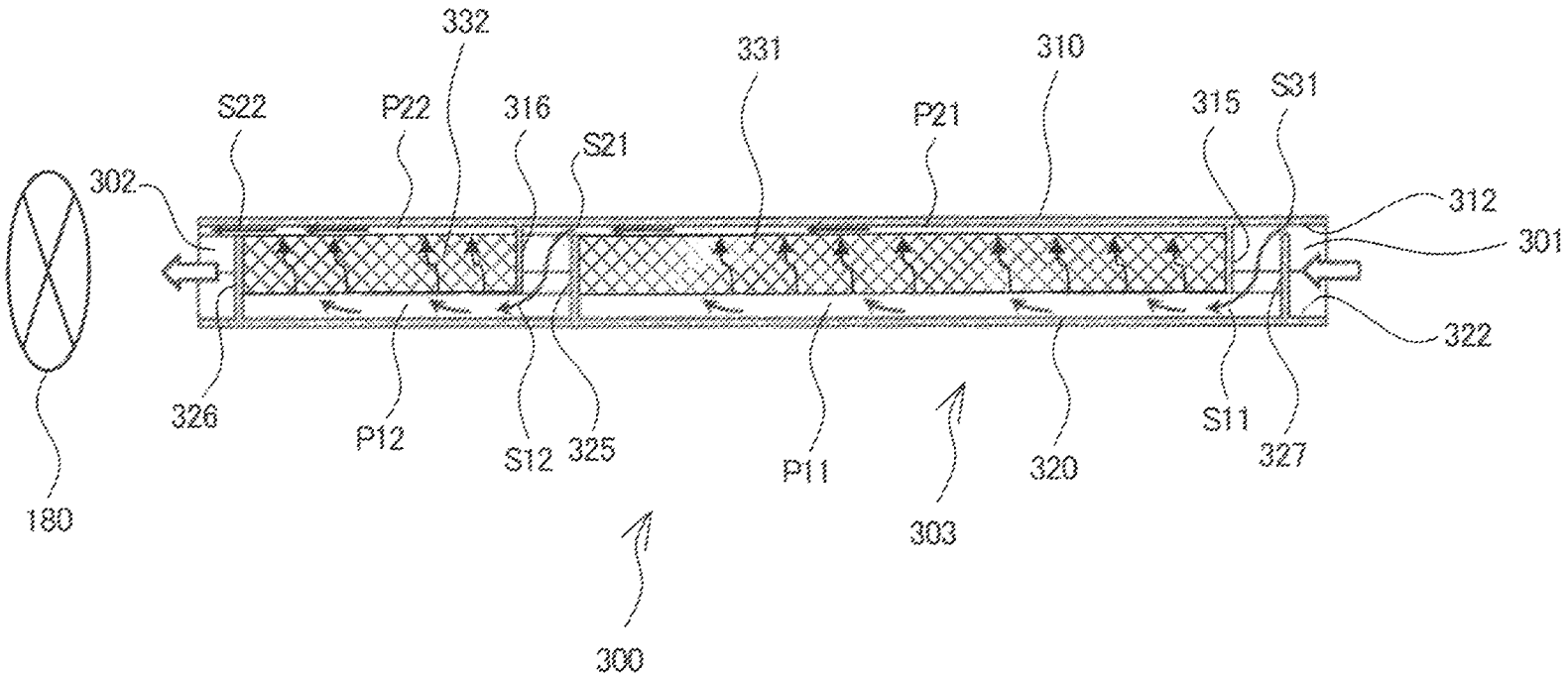
FIG. 6 is an explanatory view for illustrating air flow in the filter unit.

FIG. 6 is an explanatory view for illustrating air flow in the filter unit 300, wherein the air flow in the filter unit 300 is indicated by the arrows. The interior of the image forming apparatus 1 in which the filter unit 300 is mounted is designed to have high airtightness in order to prevent toner scattering or the like. Therefore, surrounding air is sucked through the suction portion 301 into the filter unit 300 by operating a suction fun 180 disposed on the exhaust side of the filter unit 300 to lower the atmospheric pressure in the filter unit 300 and thus produce a slight pressure difference from the surrounding area.

The air taken through the suction portion 301 into the interior of the filter unit 300 passes through the third gap S31 and the upstream first gap S11, then flows through the upstream first airflow path P11, and then flows through the upstream filter 331 from below to above against the direction of gravitational force, that is, toward the upstream second airflow path P21.

The air having passed through the upstream filter 331 flows through the upstream second airflow path P21, then passes through the upstream second gap S21 and the downstream first gap S12, and then flows through the downstream first airflow path P12. Subsequently, the air flows from below to above against the direction of gravitational force to pass through the downstream filter 332, then flows through the downstream second airflow path P22, then passes through the downstream second gap S22, and is then exhausted through the exhaust portion 302 to the outside. Powder particles contained in the air are collected by the upstream filter 331 and the downstream filter 332 during passage of the air through the upstream filter 331 and the downstream filter 332.

As thus far described, in this embodiment, the upstream first airflow path P11 and the downstream first airflow path P12 are formed along the bottom surfaces of the upstream filter 331 and the downstream filter 332 by the plurality of upstream first ribs 323 and the plurality of downstream first ribs 324 all of which are raised from the bottom surface 322 of the chassis 303 (the lower cover 320). Furthermore, the upstream second airflow path P21 and the downstream second airflow path P22 are formed along the top surfaces of the upstream filter 331 and the downstream filter 332 by the plurality of upstream second ribs 313 and the plurality of downstream second ribs 314 all of which are raised from the ceiling surface 312 of the chassis 303 (the upper cover 310).

Since the upstream first airflow path P11, the downstream first airflow path P12, the upstream second airflow path P21, and the downstream second airflow path P22 extend, not in a direction perpendicular to air-passing surfaces of the upstream filter 331 and the downstream filter 332, but along the air-passing surfaces, the thickness of the chassis 303 housing the upstream filter 331 and the downstream filter 332 can be reduced. Therefore, the filter unit 300 can be reduced in thickness, thus preventing the size expansion of the image forming apparatus 1 in which the filter unit 300 is mounted.

Since, as described above, the air passes through the upstream filter 331 and the downstream filter 332 from below to above and flows through the upstream filter 331 and the downstream filter 332 against the direction of gravitational force, powder particles collected by the upstream filter 331 and the downstream filter 332 and deposited on lower portions of the filters are likely to fall into the upstream first airflow path P11 and the downstream first airflow path P12 under their own weights, which can reduce clogging of the upstream filter 331 and the downstream filter 332 to keep smooth flow of the air.

For example, resin is preferred as a material for the chassis 303, the upstream first ribs 323, the downstream first ribs 324, the upstream second ribs 313, the downstream second ribs 314, the upstream first shield plate 315, the downstream first shield plate 316, the upstream second shield plate 325, the downstream second shield plate 326, and the third shield plate 327, by all of which the filter unit 300 is formed.

If the powder particles, such as toner, collected by the upstream filter 331 and the downstream filter 332 fall under their own weights, the fallen powder particles are accumulated in the upstream first airflow path P11 and the downstream first airflow path P12. If the amount of powder particles accumulated in the upstream first airflow path P11 and the downstream first airflow path P12 becomes excessive, the spaces for passage of air flow in the upstream first airflow path P11 and the downstream first airflow path P12 may not be able to be secured.

Therefore, the height of the upstream first ribs 323 and the downstream first ribs 324 forming the upstream first airflow path P11 and the downstream first airflow path P12, respectively, is preferably selected at a height at which the spaces for passage of air flow can be secured even if powder particles are accumulated in the upstream first airflow path P11 and the downstream first airflow path P12.

On the other hand, the amount of powder particles accumulated in the upstream second airflow path P21 and the downstream second airflow path P22 is small as compared to that in the upstream first airflow path P11 and the downstream first airflow path P12. In addition, it is preferred to reduce the thickness of the filter unit 300. Therefore, the height of the upstream second ribs 313 (i.e., the length thereof from the ceiling surface 312 toward the upstream filter 331) is preferably lower than the height of the upstream first ribs 323 and, likewise, the height of the downstream second ribs 314 (i.e., the length thereof from the ceiling surface 312 toward the downstream filter 332) is preferably lower than the height of the downstream first ribs 324.

The above embodiment illustrates a configuration in which a filter mechanism containing the upstream filter 331 located in the upstream side and members formed to surround the upstream filter 331, i.e., the upstream first ribs 323, the upstream second ribs 313, the upstream first shield plate 315, and the upstream second shield plate 325 (for example, an upstream filter mechanism F1 shown in FIG. 5A), and a filter mechanism containing the downstream filter 332 located in the downstream side and members formed to surround the downstream filter 332, i.e., the downstream first ribs 324, the downstream second ribs 314, the downstream first shield plate 316, and the downstream second shield plate 326 (for example, a downstream filter mechanism F2 shown in FIG. 5A), are aligned in series from the front side to the rear side of the chassis 303 and connected to each other. However, the present disclosure is not limited to this configuration and the filter unit may have, not a configuration in which a plurality of filter mechanisms are aligned, but a configuration formed of a single filter mechanism.

Figure 7A:
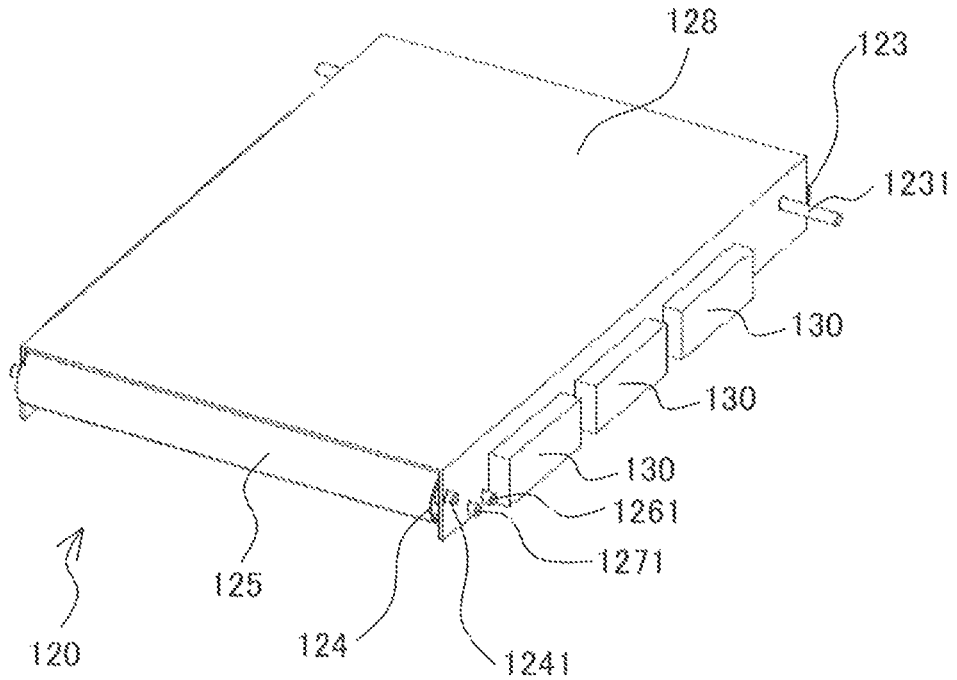
FIG. 7A is a front perspective view of an intermediate transfer unit when viewed from above.
Figure 7B:
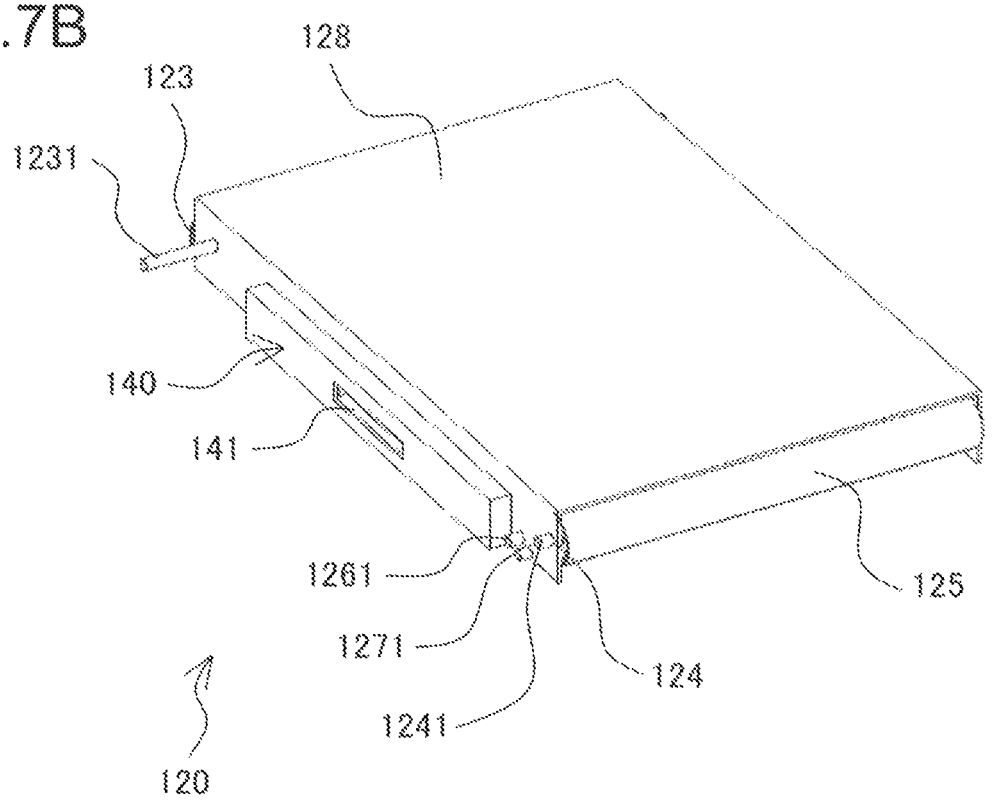
FIG. 7B is a rear perspective view of the intermediate transfer unit when viewed from above.
Figure 8A:
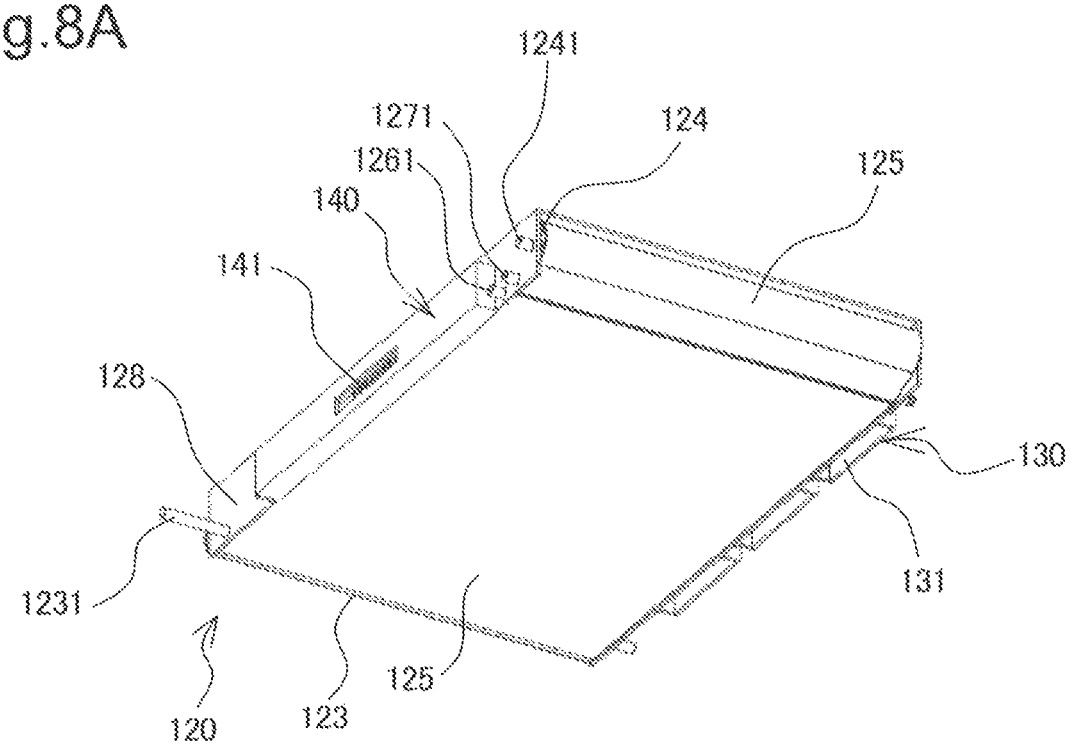
FIG. 8A is a rear perspective view of the intermediate transfer unit when viewed from below.
Figure 8B:
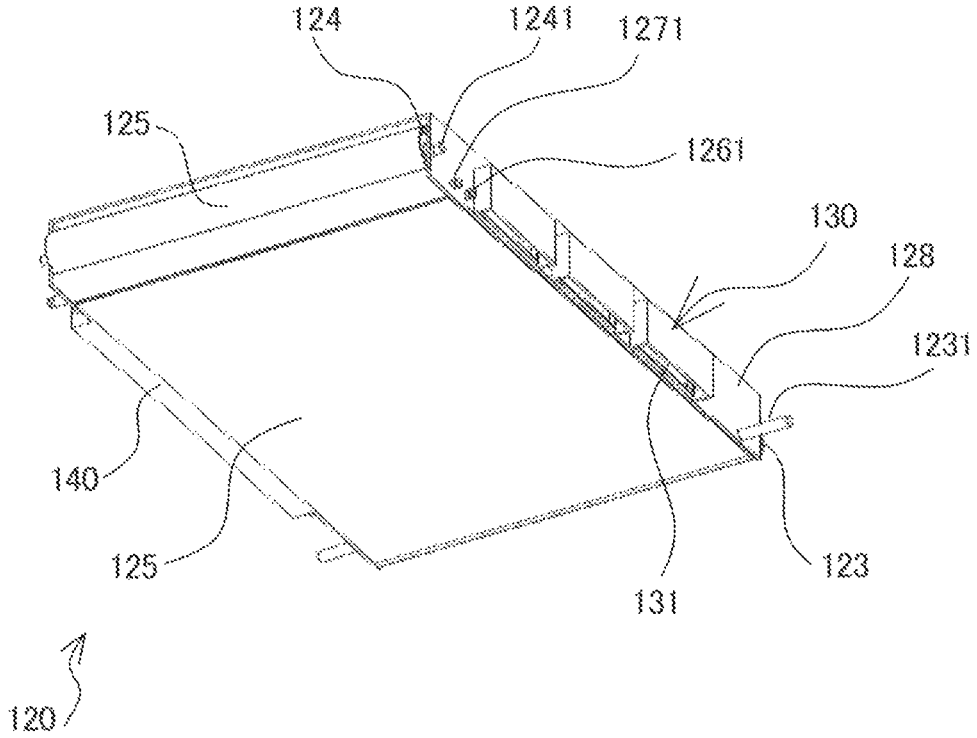
FIG. 8B is a front perspective view of the intermediate transfer unit when viewed from below.

FIG. 7A is a front perspective view of the intermediate transfer unit 120 when viewed from above. FIG. 7B is a rear perspective view of the intermediate transfer unit 120 when viewed from above. FIG. 8A is a rear perspective view of the intermediate transfer unit 120 when viewed from below. FIG. 8B is a front perspective view of the intermediate transfer unit 120 when viewed from below.

Figure 9A:
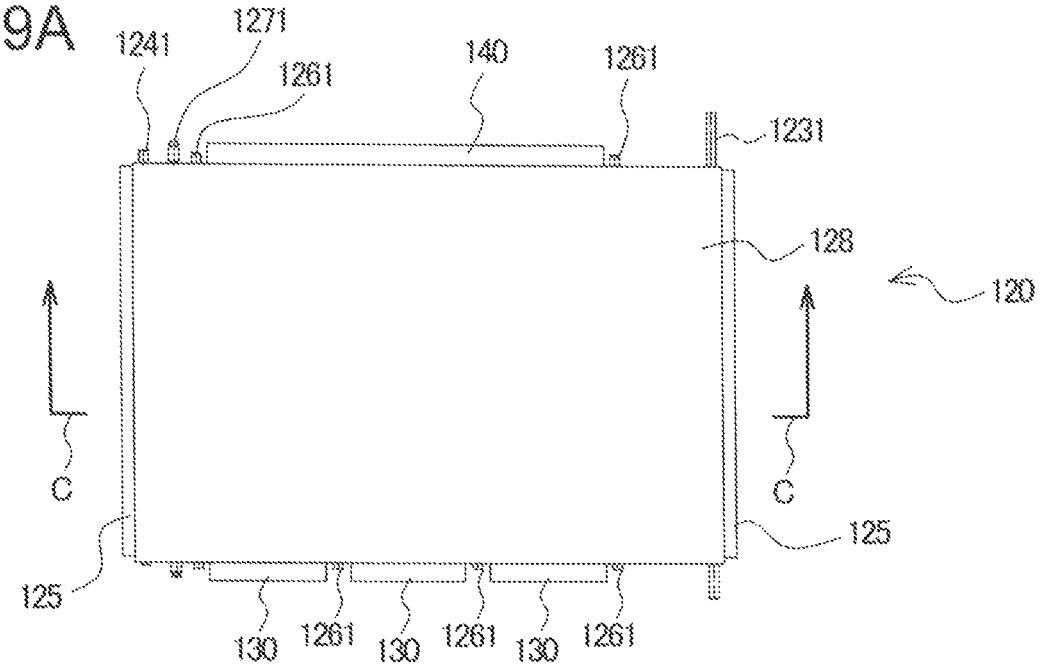
FIG. 9A is a plan view showing the intermediate transfer unit.
Figure 9B:
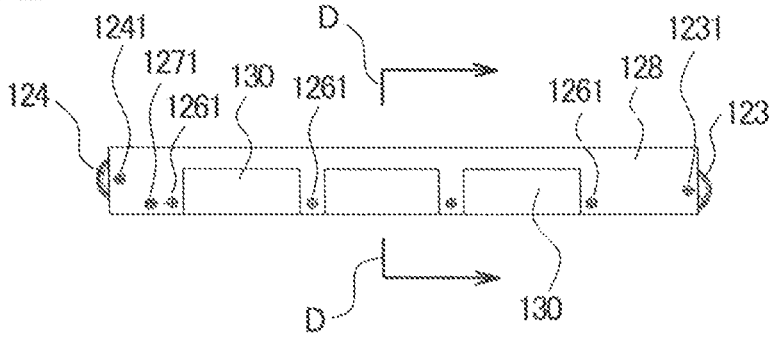
FIG. 9B is a front view showing the intermediate transfer unit.
Figure 9C:
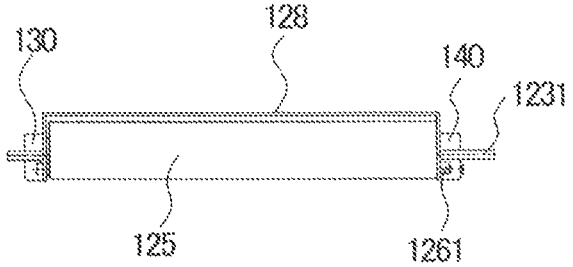
FIG. 9C is a right side view showing the intermediate transfer unit.
Figure 10A:
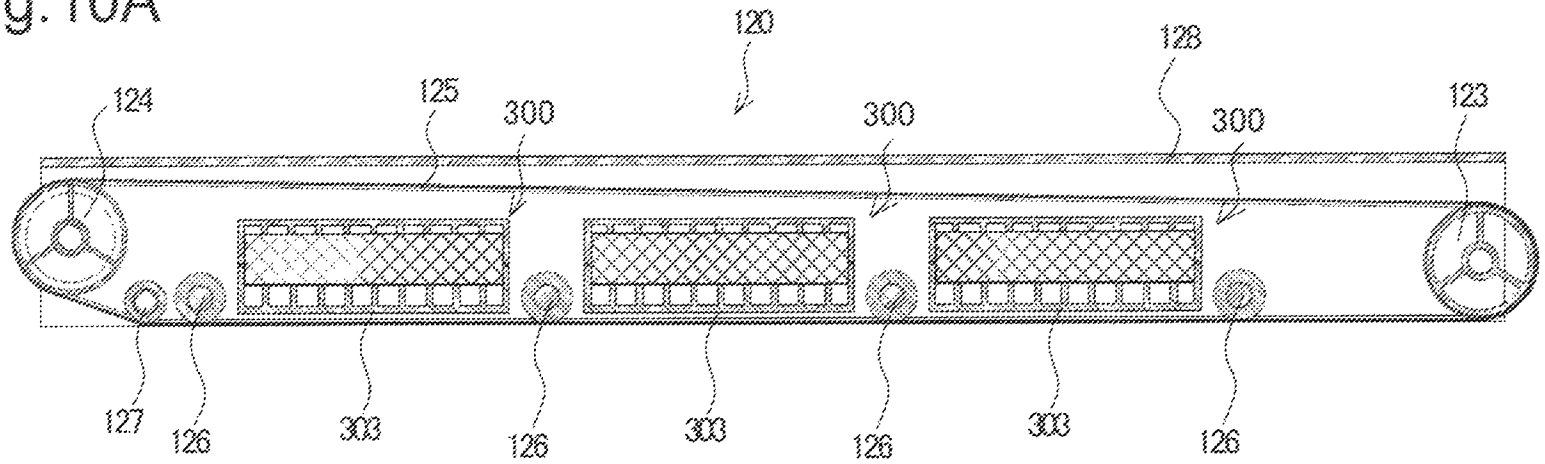
FIG. 10A is a cross-sectional view of the intermediate transfer unit taken along the line C-C in FIG. 9A.
Figure 10B:
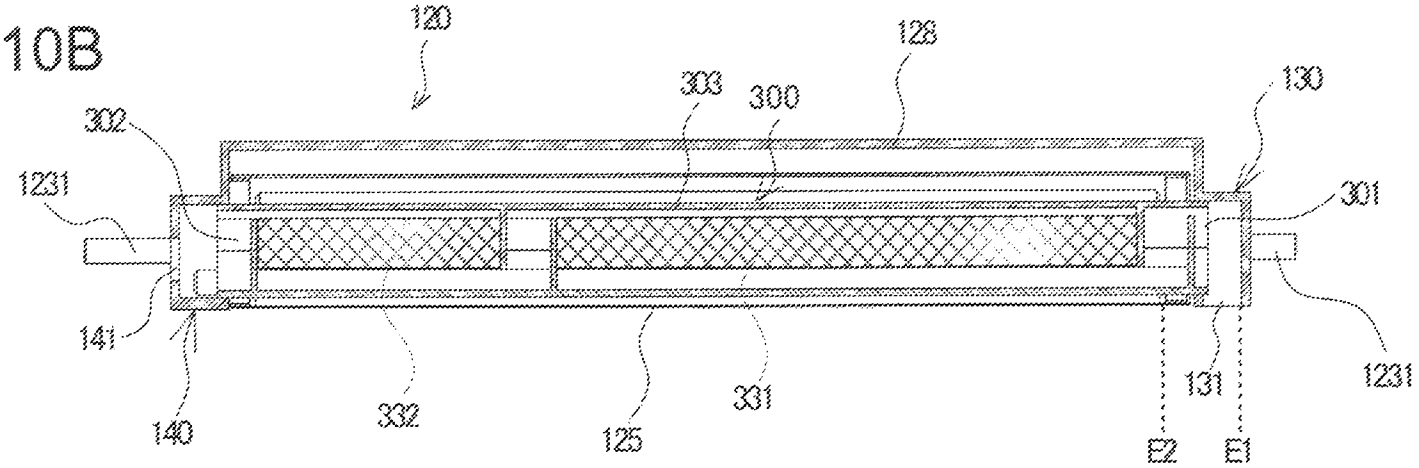
FIG. 10B is a cross-sectional view of the intermediate transfer unit taken along the line D-D in FIG. 9B.

FIG. 9A is a plan view showing the intermediate transfer unit 120. FIG. 9B is a front view showing the intermediate transfer unit 120. FIG. 9C is a right side view showing the intermediate transfer unit 120. FIG. 10A is a cross-sectional view of the intermediate transfer unit 120 taken along the line C-C in FIG. 9A. FIG. 10B is a cross-sectional view of the intermediate transfer unit 120 taken along the line D-D in FIG. 9B.

The intermediate transfer unit 120 includes: an intermediate transfer belt 125 having an outer peripheral surface to which toner images are to be transferred; a drive roller 123; a driven roller 124; a plurality of primary transfer rollers 126; a tension roller 127; and a housing 128.

The housing 128 holds the intermediate transfer belt 125, the drive roller 123, the driven roller 124, the primary transfer rollers 126, and the tension roller 127. Respective rotating shafts 1231, 1241, 1261, and 1271 of the drive roller 123, the driven roller 124, the primary transfer rollers 126, and the tension roller 127 are rotatably journaled in the housing 128.

The filter units 300 are disposed inside of the intermediate transfer belt 125 mounted around the drive roller 123, the driven roller 124, the primary transfer rollers 126, and the tension roller 127. Each filter unit 300 is disposed, inside of the intermediate transfer belt 125, between adjacent two of the primary transfer rollers 126 so that the direction of length of the chassis 303 equal to the direction of air flow in the interior of the chassis 303 is parallel to the direction of width of the intermediate transfer belt 125 perpendicular to the direction of travel of the intermediate transfer belt 125. The chassis 303 is fixed at an end thereof in the direction of its length to the housing 128. Thus, the filter units 300 (their chassis 303) are integrated with the intermediate transfer unit 120.

The suction portion 301 of each chassis 303 is connected to a suction duct 130 formed on the housing 128. The housing 128 is provided with a number of suction ducts 130 corresponding to the number of filter units 300, wherein the suction portion 301 of one filter unit 300 is connected to one suction duct 130. A suction port 131 which is an opening of the suction duct 130 opens downward. Specifically, the suction ports 131 open toward where the photosensitive drums 121Bk, 121Y, 121C, 121M (see FIG. 1B) are disposed, i.e., toward where scattered toner generates. Thus, scattered toner can be sucked through the suction ports 131 and efficiently taken through the suction ducts 130 into the chassis 303 of the filter units 300.

Figure 11:
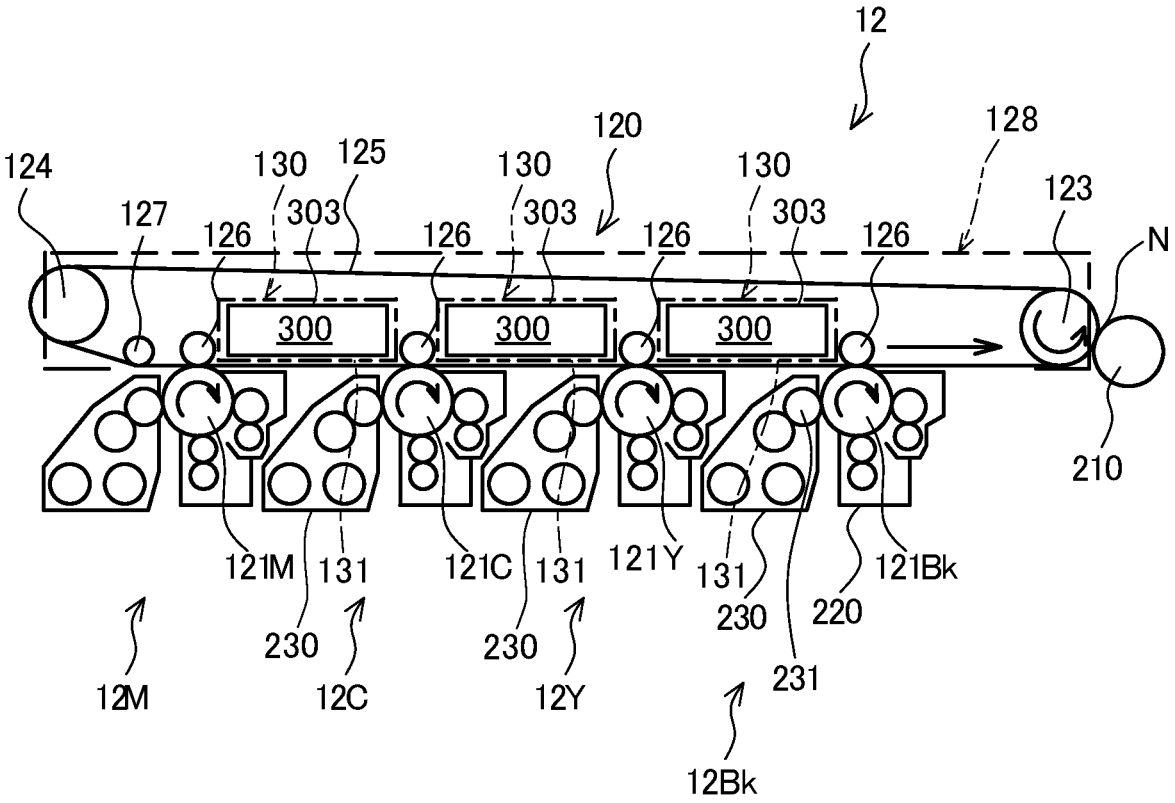
FIG. 11 is a front view schematically showing the image forming section and its surrounding portions, and illustrating that disposed positions of suction ports of suction ducts formed on a housing are supply positions where toner is supplied from developing devices to respective associated photosensitive drum.

Furthermore, the suction ports 131 are disposed in the vicinity of supply positions where toner is supplied from the developing rollers 231 (see FIG. 1B) of the developing devices 230 to the respective associated photosensitive drums 121Bk, 121Y, 121C, and 121M. Specifically, the positions where the suction ports 131 are disposed in the direction of travel of the intermediate transfer belt 125 are the supply positions where toner is supplied from the developing devices 230 to the respective associated photosensitive drums 121Bk, 121Y, 121C, and 121M and the suction ports 131 are located above the supply positions. Furthermore, FIG. 11 is a front view schematically showing the image forming section 12 and its surrounding portions, and illustrating that disposed positions of the suction ports 131 of the suction ducts 130 formed on the housing 128 are supply positions where toner is supplied from the developing devices 230 to the respective associated photosensitive drum.

An outside end E1 (see FIG. 10B) of each suction port 131 is located laterally of an end E2 (see FIG. 10B) of the intermediate transfer belt 125 in the direction of width of the intermediate transfer belt 125. Scattered toner generated at the above supply positions located inwardly of the end of the intermediate transfer belt 125 in the direction of width of the belt moves along the peripheral surface of the intermediate transfer belt 125 to the end of the intermediate transfer belt 125 in the direction of width of the belt and then moves from this end to above the peripheral surface of the intermediate transfer belt 125. Therefore, the scattered toner is efficiently taken in the filter units 300 by locating the outside ends E1 of the suction ports 131 laterally of the end E2 of the intermediate transfer belt 125 in the direction of width of the belt.

Although the description in this embodiment has been given of the case where the suction ducts 130 are provided on the housing 28, the suction ducts 130 may be provided on the chassis 303 of the respective associated filter units 300.

In this case, holes allowing passage of the suction ducts 130 are formed in the housing 128. Thus, the outside ends E1 of the suction ports 131 are located laterally of the end E2 of the intermediate transfer belt 125 in the direction of width of the intermediate transfer belt 125.

Furthermore, the housing 128 of the intermediate transfer unit 120 has a single exhaust duct 140 formed thereon so as to be connected to all of the exhaust portions 302 of the respective chassis 303 of the plurality of filter units 300. An exhaust port 141 opens into the exhaust duct 140. Furthermore, the suction fan 180 (see FIG. 6) is disposed to face the exhaust port 141. As for the exhaust fan 180, a dedicated suction fan may be additionally mounted in the image forming apparatus 1 or a suction fan already mounted in the image forming apparatus 1 may be utilized.

In another embodiment of the exhaust duct 140, instead of the structure in which a single exhaust duct 140 connected to the plurality of exhaust portions 302 is formed on the housing 128, individual exhaust ducts 140 may be provided one for each of the plurality of exhaust portions 302. In this case, suction fans are preferably provided one for each of the exhaust ducts 140.

In still another embodiment of the exhaust duct, the exhaust ducts 140 may be provided on the chassis 303 of the respective associated filter units 300. In this case, holes allowing passage of the exhaust ducts 140 are formed in the housing 128. Thus, the exhaust ports 141 of the exhaust ducts 140 are located laterally of the end of the intermediate transfer belt 125 in the direction of width of the intermediate transfer belt 125. Also in this case, suction fans are preferably provided one for each of the exhaust ducts 140.

According to the above embodiment, since each chassis 303 containing the upstream filter 331 and the downstream filter 332 disposed therein is disposed so that the direction of length of the chassis 303 is parallel to the direction of width of the intermediate transfer belt 125 and the suction portions 301 and the exhaust portions 302 of the chassis 303 are oriented laterally in the direction of width of the intermediate transfer belt 125, air suction and exhaust can be efficiently performed. Furthermore, since the chassis 303 are disposed inside of the intermediate transfer belt 125, an originally unoccupied space inside of the intermediate transfer belt 125 can be effectively utilized for the placement of the filter units 300, thus preventing the size expansion of the intermediate transfer unit 120. In addition, since the chassis 303 are fixed to the housing 128, the intermediate transfer unit 120 can be increased in strength.

Since each chassis 303 containing the upstream filter 331 and the downstream filter 332 disposed therein is integrated with the intermediate transfer unit 120 which is a unit to be replaced periodically, the upstream filter 331 and the downstream filter 332 can be replaced concurrently with the replacement of the intermediate transfer unit 120, thus improving the maintenance workability.

An example of the method for preventing the occurrence of an image defect due to toner scattering is to mount a filter for collecting scattered toner in an image forming apparatus. However, in the case where such a filter is mounted in a relatively small printer, such as a desktop printer, there arises a problem of difficulty in securing a location where the filter is disposed. Furthermore, if the filter is mounted, the size of the apparatus may be increased and an additional work for replacing the filter decreases the maintenance workability.

In addition, some image forming apparatuses are equipped with an intermediate transfer unit including an intermediate transfer belt. Many of housings forming shells of such intermediate transfer units have a U-shape, which causes concern about strength poverty.

Unlike the above known technique, in the above embodiment, the size expansion of the image forming apparatus can be prevented, the maintenance workability can be improved, and the strength of the intermediate transfer unit can be increased.

The structure and processing shown in the above embodiment with reference to FIGS. 1 to 10B are merely illustrative of the present disclosure and not intended to limit the present disclosure to the above particular structure and processing.

While the present disclosure has been described in detail with reference to the embodiments thereof, it would be apparent to those skilled in the art the various changes and modifications may be made therein within the scope defined by the appended claims.

What is claimed is:

1. An intermediate transfer unit comprising:

an intermediate transfer belt mounted around two belt rollers to travel in an endless path around the belt rollers;

a plurality of transfer rollers that are disposed opposite to a plurality of image carriers with the intermediate transfer belt in between, the plurality of image carriers being aligned along an outer periphery of the intermediate transfer belt and allowing respective toner images to be formed thereon, and transfers the toner images from the image carriers to the outer periphery of the intermediate transfer belt;

a housing that journals the intermediate transfer belt and the transfer rollers; and a filter unit including a suction portion provided at a front end thereof to suck air therethrough, an exhaust portion provided at a rear end thereof to exhaust the air therethrough, and a rectangular chassis provided internally with a filter capable of collecting powder particles, wherein the filter unit is disposed inside of the intermediate transfer belt mounted around the two belt rollers so that a direction of length of the chassis being the same as a direction of the air flowing through an interior of the chassis is oriented parallel to a direction of width of the intermediate transfer belt perpendicular to a direction of travel of the intermediate transfer belt, and the filter unit is fixed to the housing.

2. The intermediate transfer unit according to claim 1, wherein a suction duct connected to the suction portion is formed on the housing, a suction port of the suction duct opens toward where the image carriers are disposed, and the suction port is provided so that an outside end of the suction port is located laterally of an end of the intermediate transfer belt in the direction of width of the intermediate transfer belt.

3. The intermediate transfer unit according to claim 2, wherein a position where the suction port is disposed in the direction of travel of the intermediate transfer belt is a supply position where toner is supplied from developing devices to the respective associated image carriers.

4. The intermediate transfer unit according to claim 2, wherein the suction duct is provided on the chassis of the filter unit and a hole allowing passage of the suction duct is formed in the housing.

5. The intermediate transfer unit according to claim 1, wherein the plurality of transfer rollers are three or more transfer rollers, the filter unit is a plurality of filter units, and each filter unit of the plurality of filter units is disposed between adjacent two of the plurality of transfer rollers in the direction of travel of the intermediate transfer belt.

6. The intermediate transfer unit according to claim 5, wherein a single exhaust duct connected to all of the exhaust portions of the respective plurality of filter units is formed on the housing.

7. The intermediate transfer unit according to claim 6, wherein an exhaust port opens into the exhaust duct and a suction fan is disposed to face the exhaust port.

8. The intermediate transfer unit according to claim 1, wherein the filter unit comprises:

the chassis:

a plurality of first ribs disposed parallel to sidewalls of the chassis to rise from a bottom surface of the chassis toward an interior of the chassis and forming a first airflow path; and a plurality of second ribs disposed parallel to the sidewalls of the chassis to rise from a ceiling surface of the chassis toward the interior of the chassis and forming a second airflow path, wherein the filter is disposed in the interior of the chassis so as to be sandwiched by the plurality of first ribs and the plurality of second ribs with respective spaces left from the ceiling surface and the bottom surface of the chassis, and wherein the filter unit further comprises:

a first shield plate that extends in a direction perpendicular to a direction of extension of the first ribs and the second ribs and is raised from the ceiling surface of the chassis toward the interior of the chassis to cover up a front end of the filter while forming a first gap with the bottom surface of the chassis; and a second shield plate that extends in the direction perpendicular to the direction of extension of the first ribs and the second ribs and is raised from the bottom surface of the chassis toward the interior of the chassis to cover up a rear end of the filter while forming a second gap with the ceiling surface of the chassis.

9. An image forming apparatus comprising the intermediate transfer unit according to claim 1 and transferring a toner image formed by the intermediate transfer unit to a recording medium to form an image.

* * * * *